United States Patent [19]

Haefner et al.

[11] Patent Number: 4,958,499

[45] Date of Patent: Sep. 25, 1990

[54] METHOD AND APPARATUS FOR CHECKING THE OPERATION OF A REFRIGERATOR-OPERATED CRYOGENIC PUMP

[75] Inventors: Hans-Ulrich Haefner, Cologne; Manfred Klotz, Kahl/Main; Wilhelm Strasser, Bergisch Gladbach, all of Fed. Rep. of Germany

[73] Assignee: Leybold Aktiengesellschaft, Fed. Rep. of Germany

[21] Appl. No.: 337,670

[22] Filed: Apr. 13, 1989

[30] Foreign Application Priority Data

Apr. 13, 1988 [EP] European Pat. Off. ..... 88105857

[51] Int. Cl.[5] ..... B01D 8/00

[52] U.S. Cl. ..... 62/55.5; 62/127; 417/901

[58] Field of Search ..... 62/55.5, 129, 127; 417/901

[56] References Cited

U.S. PATENT DOCUMENTS

| | | | |
|---|---|---|---|
| 4,614,093 | 9/1986 | Bachler | 62/55.5 |
| 4,667,477 | 5/1987 | Matsuda et al. | 62/55.5 |
| 4,757,689 | 7/1988 | Bachler et al. | 417/901 X |

FOREIGN PATENT DOCUMENTS

| | | |
|---|---|---|
| 0250613 | 1/1988 | European Pat. Off. . |
| US83/01005 | 2/1984 | PCT Int'l Appl. . |
| 84/00404 | 2/1984 | World Int. Prop. O. . |

*Primary Examiner*—William E. Wayner

*Attorney, Agent, or Firm*—Hill, Van Santen, Steadman & Simpson

[57] ABSTRACT

Method and apparatus for checking the operation of a refrigerator-operator cryogenic pump. The method for checking the operation of a refrigerator-operated cryogenic pump having a cold head with at least one refrigerating unit that is equipped with a pump surface. Various data of the cryogenic pump, particularly the net refrigerating power of the refrigerating unit, are interrogated under various operating conditions and these data are compared to rated data. The method and apparatus are also directed to a diagnostic apparatus with which the interrogation is implemented.

11 Claims, 1 Drawing Sheet

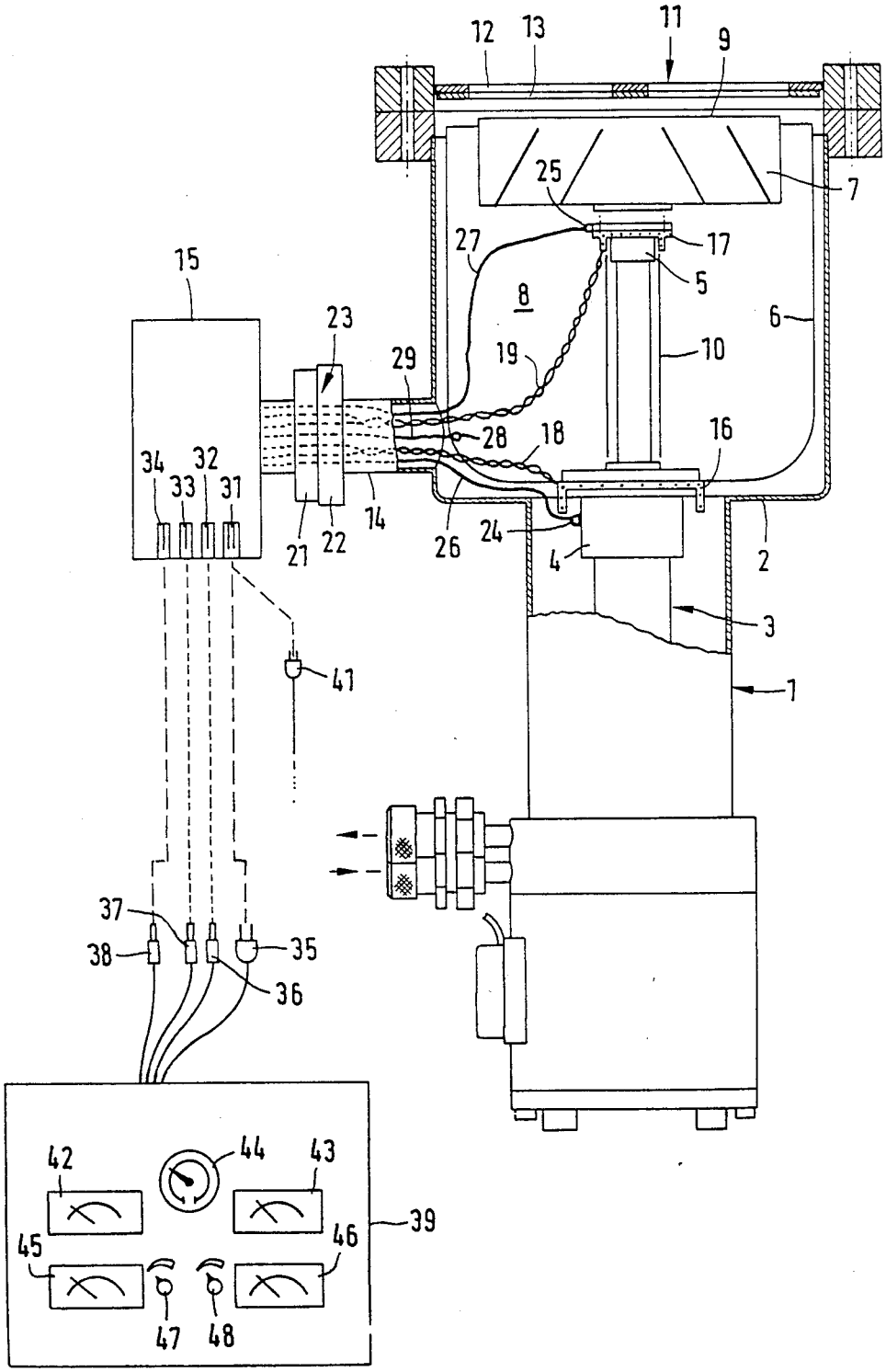
12
13
11
9
25
7
27
17
5
15
8
6
23
29
19
10
28
18
16
34
32
33
31
14
21
22
26
24
4
2
3
41
1
37
38
35
36
42
44
43
39
45
46
47
48

METHOD AND APPARATUS FOR CHECKING THE OPERATION OF A REFRIGERATOR-OPERATED CRYOGENIC PUMP

BACKGROUND OF THE INVENTION

The present invention is directed to a method for checking the operation of a refrigerator-operated cryogenic pump having a cold head with at least one refrigeration stage or unit that is equipped with a pump surface. The present invention is also directed to a cryogenic pump and to an apparatus for the implementation of this method.

It is often difficult in industrial utilization of refrigerator-operated cryogenic pumps to identify whether a fault indicated by the cryogenic pump (such as, poor final temperature, rise of the temperatures, etc.) is caused in the cryogenic pump itself or is a result of external changes. Based on this lack of knowledge, premature and expensive measures are occasionally undertaken (such as, pump replacement or the like) that could have been avoidable given more information.

SUMMARY OF THE INVENTION

An object of the present invention is to provide a method of the type initially cited as well as an apparatus or cryogenic pump suitable for the implementation of this method that allows the operation of a cryogenic pump to be checked.

This object is inventively achieved in that data of the cryogenic pump are interrogated under various operating conditions and in that the interrogated data are compared to rated data. A determination can be made on the basis of the comparison of the interrogated data to the rated data as to whether, for example, there is a decrease in performance of the refrigerator of the cryogenic pump itself or whether the decrease in performance is due to external changes, for example a change of the gas composition, a modified gas load, a modified radiation load or the like.

A typical procedure in the diagnosis of a cryogenic pump is, for example, as follows: the cryogenic pump is first regenerated, is pre-pumped to about $10^{-2}$ mbar and, subsequently, is run cold with a closed high-vacuum valve. The temperature curve of the refrigeration unit of the refrigerator is monitored or recorded during the cold running. When a cryogenic pump having a plurality of refrigerating units is involved, then it is expedient to record the temperature of all refrigerating units. When the chronological development of the temperatures is too slow or when the time by which the defined temperature is to be reached is too long (i.e. longer than known reference values), then an impermissible heat source or a leakage can be present. A further possibility is that the refrigerator itself has performance weaknesses.

When the cryogenic pump is regenerated, the net refrigerating power of the refrigeration unit or refrigeration units can be measured for further identification of the operation of the pump. This, for example, can occur in that the refrigerating units are heated with the assistance of a manually or automatically controlled heating source and the temperature of the refrigeration units is thereby observed. When the net refrigerating power is lower than the typical, known reference values for the respective pump, then the refrigerator is no longer providing an adequate performance.

These steps can be followed by observation of the temperature behavior under operating conditions. When, for example, the temperature of a second unit suddenly rises above a maximally allowable value after the valve is opened, then the gas load can be too high; an unknown source of disturbance can be present. A relatively fast temperature rise can also occur for a modified gas composition. When the temperature of a first unit rises gradually but again sinks after the high-vacuum valve it closed, then it can be concluded that a high proportion of water vapor is condensed at the baffle. The water ($H_2O$) coating on the baffle has an effect similar to a blackening of the baffle, so that the radiation load has increased for an open valve. When the temperature difference of, in particular, the first unit is disproportionately high for an open and closed valve, then the thermic radiation load from the recipient is too high. Measures for reducing the radiation load must then be undertaken.

It is not only the observation of the temperature but also the observation of the pressure in the pump that is useful. For example, if the pressure is also observed in addition to the temperature when regenerating the pump, then conclusions regarding the nature of the gases being released are possible since the pressure curve dependent on the temperature is dependent on the type of gas.

BRIEF DESCRIPTION OF THE DRAWING

The feature, of the present invention which are believed to be novel, are set forth with particularity in the appended claims. The invention, together with further objects and advantages, may best be understood by reference to the following description taken in conjunction with the accompanying drawing, in which:

The single FIGURE depicts an exemplary embodiment of a cryogenic pump having a diagnostic apparatus.

DESCRIPTION OF THE PREFERRED EMBODIMENT

The cryogenic pump 1 together with the housing 2 shown in the FIGURE has a two-stage refrigerator 3 (only partially shown) whose refrigerating units are referenced 4 (first stage) and 5 (second stage). A pot-shaped pump surface or shielding 6 is secured to the first stage 4 in a good thermally conductive manner, so that this surrounds the interior 8 of the pump in common with a baffle 7 that is carried and cooled by the shielding 6. The pump surfaces 10 of the second refrigerator stage 5 that are connected in good thermally conductive fashion to the second refrigeration unit 5 are situated in the interior 8. The entry opening 9 of the pump that is equipped with the baffle 7 is preceded by a schematically illustrated valve 11. The valve 11 has a fixed disk 12 and a rotatable disk 13 each of which has essentially radial slotted apertures. The valve 11 can be actuated by turning the disk 13.

The housing 2 of the cryogenic pump 1 is equipped with a connecting sleeve 14 that carries the monitoring device 15. A circuit for supplying the electrical heater devices 16 and 17 with which the refrigerating units 4 and 5 of the two-stage refrigerator are equipped is situated in this monitoring device 15. A vacuum-tight lead-through 23 is provided in the region of flanges 21, 22 at the supply device 15 or at the connecting sleeve 14 for the connecting lines 18 and 19 between the monitoring device 15 and the heating devices 16, 17.

Temperature sensors 24 and 25 (one is provided at each of the refrigerating units 4 and 5) are also situated in the cryogenic pump, their instrument leads 26 and 27 likewise leading to the monitoring device 15. Finally, a pressure sensor 28 whose instrument lead 29 likewise leads to the monitoring device 15 is also situated in the pump 1.

A monitoring device 15 is equipped with plug sockets 31 through 34 into which plugs 35 through 38 of the diagnostic apparatus 39 can be plugged. The plug 35 and socket 31 serve the purpose of power supply. In case the diagnostic apparatus 39 is not connected to the supply device 15 or the cryogenic pump 1, the plug socket 31 is to be supplied with voltage (plug 41) from a different power source. The heating devices 16, 17 can then serve, for example, for regenerating the pump surfaces 6, 7, 10 of the cryogenic pump 1.

The diagnostic apparatus 39 is equipped with instruments 42 through 44 that allow the values supplied by the sensors 24, 25 and 28 to be read. The scales 42 and 43 serve for indicating the temperatures $T_1$ and $T_2$. The scale 44 shows the pressure prevailing in the pump. The pressure-measuring means 44 and the diagnostic apparatus is not required when, as is frequently the case, the cryogenic pump itself is equipped with a pressure-measuring means.

Two further instruments 45 and 46 are provided, each having a potentiometer that is adjustable with the rotary knobs 47, 48, respectively. The heating power of the heating devices 16 and 17 can be set and measured by these instruments. It thereby becomes possible to measure the net refrigerating power of the two refrigerating units 4 and 5. This occurs in such fashion that the cold heads are brought to a defined temperature (for example, 80K at the first unit and 20K at the second unit). The heating capacity required for this purpose is the net refrigerating power of the pump.

For diagnosis of a cryogenic pump of the type illustrated, the diagnostic apparatus 39 is first connected to the supply device 15 in that the illustrated plugs are introduced into the appertaining sockets. Dependent upon the condition in which the cryogenic pump to be investigated is situated, a complete diagnosis begins either with the regeneration of the cryogenic pump or with the cold running, potentially supplementing one another during the pumping process as well.

An idea of the type of gases occurring during pumping is obtained when the temperature curve of $T_2$, $T_1$ as well as the pressure are observed and recorded simultaneously during the regenerating event of the cryogenic pump. When, for example, a noticeable pressure rise already occurs after brief heating at about $T_2=25$ to 30K, then a great quantity of hydrogen (or some other gas, i.e. Helium or Neon absorbed at the second unit) was previously pumped. When a significant pressure rise further occurs at higher temperatures (about $T_2$ somewhat greater than 50 to 70K), then it results from permanent gases such as $N_2$, $O_2$ and Ar that condensed at the second unit. A great quantity of pumped water vapor continues to be noticed when the appertaining pressure rise during regeneration does not begin until $T_1$ is greater than about 200K and is in the mbar range (evaporation of the solid $H_2O$ ice) for a relatively long time despite continuous further heating of the first unit, about a few tens of minutes.

During the cold running of the cryogenic pump, the temperature change or the time in which defined temperatures were reached can be observed. When these values do not agree with the rated values, then the refrigerator itself can be malfunctioning. The measurement of the net refrigerating power of the refrigerating units also provides information regarding this point. The simultaneous observation of the pressure provides information about the tightness of the valve 11 or other possible losses of tightness at flange connections, at the cryogenic pump safety valve or the like.

Finally, diagnostic steps are also possible when a cryogenic pump is in operation. When the valve 11 is closed for a brief time, then temperature discontinuities having a defined order of magnitude must occur. As previously mentioned, an excessively great temperature rise after an opening of the valve 11 is an indication that the radiation load from the recipient is too high. Corrective measures must then be undertaken.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A method for checking the operation of a refrigerator-operated cryogenic pump having a cold head with at least one refrigerating unit that is equipped with a pump surface, comprising the steps of: interrogating various data of the cryogenic pump under different operating conditions; and comparing the interrogated data to rated data, at least one of the interrogated data being a net refrigerating power of the refrigerating unit which is measured and compared to a rated value.

2. The method according to claim 1, wherein another of the interrogated data is a temperature of the refrigerating unit which is monitored during the cold running of the pump, a chronological change of this temperature for the time required until a defined temperature is reached being compared to a corresponding rated value.

3. The method according to claim 1, wherein another of the interrogated data is the temperature of the refrigerating unit which is recorded for an open and closed valve, the valve being connected to the pump.

4. The method according to claim 1, wherein the method further comprises observing pressure in the cryogenic pump during the regeneration in addition to temperature.

5. The method according to claim 1, wherein the steps of the method are successively executed.

6. A method for checking the operation of a refrigerator-operated cryogenic pump having a cold head with at least one refrigerating unit that is equipped with a pump surface, comprising the steps of:

regenerating the cryogenic pump;

providing a high-vacuum valve and running the cryogenic pump cold with the valve closed after regenerating the pump;

recording a temperature curve of a change in actual temperature over an actual time of running for the refrigerating unit;

providing a rated time at which a rated temperature is reached when the cryogenic pump is operating properly; and comparing the rated time to the actual time of the recorded temperature curve to check the operation of the pump.

7. The method according to claim 6, wherein the method further comprises the steps of:

heating the refrigeration unit with a means for heating connected to a means for supplying heating power during the regeneration of the cryogenic pump;

monitoring the temperature of the refrigeration unit during the regeneration of the cryogenic pump; and measuring a net refrigerating power by bringing the cold head of the refrigerating unit to a predetermined temperature, the heating power required for this being the net refrigerating power.

8. The method according to claim 7, the method further comprising the steps of:

measuring pressure in the pump during regeneration of the pump; and forming a pressure curve from the measure pressure which is dependent on the temperature of the refrigerating unit.

9. The method according to claim 7, wherein the pump has first and second refrigerating units and a change in temperature is recorded for each unit during regeneration and during the running of the pump.

10. The method according to claim 8, the pump having first and second refrigerating units, the method further comprising the steps of:

during operating conditions of the cryogenic pump, opening the high-vacuum valve;

monitoring the temperature of the second unit for a sudden rise in temperature above a maximum allowable value;

closing the high-vacuum valve; and monitoring the temperature of the first unit for a gradual rise in temperature followed by a decrease in temperature.

11. The method according to claim 10, the method further comprising the steps of:

monitoring the temperature of the first unit when the valve is open and when the valve is closed; and comparing the measured temperatures of the first unit for the open and closed valves.

* * * * *